United States Patent [19]

Kampen et al.

[11] Patent Number: 4,889,461

[45] Date of Patent: Dec. 26, 1989

[54] WRAPPING APPARATUS FOR A BOOK COVER PRODUCTION MACHINE

[75] Inventors: Jan-Dieter Kampen, Lubbecke; Karl-Friedrich Schroder, Rahden, both of Fed. Rep. of Germany

[73] Assignee: Kolbus GmbH & Co. KG, Rahden, Fed. Rep. of Germany

[21] Appl. No.: 216,663

[22] Filed: Jul. 7, 1988

[30] Foreign Application Priority Data

Jul. 10, 1987 [DE] Fed. Rep. of Germany ..... 3722877

[51] Int. Cl.[4] ..... B42C 11/04; B42C 7/00; B31F 1/00

[52] U.S. Cl. ..... 412/19; 412/17; 156/443

[58] Field of Search ..... 412/17, 19, 21; 156/444, 291, 479, 482, 443; 53/116; 93/61 R, 62, 73

[56] References Cited

U.S. PATENT DOCUMENTS

| | | | |
|---|---|---|---|
| 2,749,697 | 6/1956 | Poche | 56/328.1 |
| 2,749,967 | 6/1956 | Bach et al. | 412/17 |
| 3,009,179 | 11/1961 | Schramm | 412/17 |
| 3,068,501 | 12/1962 | McCahon | 412/17 |
| 3,398,038 | 8/1968 | Crawford | 412/17 |
| 3,515,257 | 6/1970 | Smith et al. | 412/21 |
| 4,248,657 | 2/1981 | Henry | 412/17 |

FOREIGN PATENT DOCUMENTS

| | | | |
|---|---|---|---|
| 1204625 | 6/1965 | Fed. Rep. of Germany | 412/17 |

*Primary Examiner*—Douglas D. Watts
*Assistant Examiner*—Paul M. Heyrana, Sr.
*Attorney, Agent, or Firm*—Chilton, Alix & Van Kirk

[57] ABSTRACT

Wrapping apparatus for use in the production of book covers employs wrapping systems for folding an overlay sheet around the leading and trailing edges of a cover board and subsequently clamping the folded-over overlay and cover board together for a defined period of time. The wrapping systems each comprise a tiltably mounted wrapping rail, controlled in a displacement-dependent mode, which cooperates with an associated support rail to form a clamp.

20 Claims, 7 Drawing Sheets

WRAPPING APPARATUS FOR A BOOK COVER PRODUCTION MACHINE

BACKGROUND OF THE INVENTION

1. Field of the Invention

The present invention relates to the manufacture of books and particularly to the application of overlays to the cover boards of hard cover books. More specifically, this invention is directed to wrapping apparatus for book cover production machines and especially to apparatus for folding the overlay material, which projects beyond the leading and trailing edges of a cover board, around the said edges and holding the thus folded overlay in contact with the continuously moving board. Accordingly, the general objects of the present invention are to provide novel and improved methods and apparatus of such character.

2. Description of the Prior Art

U.S. Pat. No. 2,749,967 discloses apparatus for use in the production of book covers wherein the wrapping of the overlay material around the edges of the backing board, the backing board and overlay moving continuously along a conveyor system, is accomplished by wrapping the side edges prior to the wrapping of the leading and trailing edges. In the patented apparatus, in order to accomplish wrapping of the side edges, the cover units comprising the board and an oversize overlay which has previously been bonded thereto are clamped and fed through the apparatus by transport chains. The overlay is first turned upwardly and subsequently folded back around the board side edges by means of wrapping shafts which travel with the cover units, the wrapping shafts being movable inwardly with respect to the cover unit. Subsequently, the cover units, supported on an endless and continuously moving transport belt, are delivered to a folding mechanism which is installed above the movement path defined by the belt. The folding mechanism, which can be selectively translated into the path of movement of the cover units, wraps the overlay around the leading edge of the board. This wrapping is accomplished by the use of wrapping fingers which are positioned transversely with respect to the direction of movement of the cover unit. The wrapping fingers are mounted side-by-side on a shaft and are spring loaded so as to rest against a hold-down shaft when in the retracted position. The wrapping fingers are lifted against their spring bias by the moving cover units so as to be swung upwardly and out of the plane in which the cover units move.

Continuing to discuss the apparatus of U.S. Pat. No. 2,749,967, as a result of the movement of the wrapping fingers around the leading edge of a cover unit, the overhanging overlay material is folded around the leading edge of the board. The folded overlay is then pressed into contact with the board by means of pressure rollers which follow the wrapping fingers. The trailing edges of the cover boards are wrapped in an analogous manner, but by means of wrapping rails that are installed on driven chains which move on endless paths. These wrapping rails are propelled, for a short period, at a speed in excess of that at which the cover units move. The wrapping rails, when overtaking the moving cover unit, come to bear thereagainst and i so doing overcome a spring force. In order to prevent the action of the trailing edge wrapping rail from pushing the cover unit forwardly, motion retarding fingers which act on the leading edge of the cover are provided. Pressure rollers, resiliently mounted at locations such that they follow the wrapping rail, serve to press the overlay material against the board once the folding action has been accomplished by the rail.

The above briefly described book cover production machine has a number of disadvantages. By way of example, the wrapping fingers rock relatively rapidly around the cover board edge with the result that the overlay material is neither pressed flat against the leading edge nor is it held against the edge or the surface of the board to which the overlay is to be adhered. Thus, the desired, taut folding of the overlay material around the board edges cannot be achieved with apparatus of the type disclosed in U.S. Pat. No. 2,749,967, this being particularly true when employing overlay materials which are relatively stiff. The foregoing deficiency is, in large measure, attributable to the relatively small contact pressures exerted by the wrapping fingers. However, applying a greater pressure through the use of stronger spring elements would not solve the problem since the spring forces must be overcome by the moving cover unit and the possibility of damage to the overlay material increases significantly as the spring force which must be overcome increases.

It is also to be noted that, in the case of a wrapping apparatus of the type disclosed in U.S. Pat. No. 2,749,967, the wrap-folded overlay material is not held firmly against the cover board for a defined period of time. The maintaining of pressure against the wrap-folded overlay material for an "initial bonding time" is an absolute necessity if adhesive-bonding is to be reliably achieved. The period of time during which the pressure must be maintained is a function of the type of adhesive used, the thickness of the adhesive applied and the nature of the overlay material and cover board being processed. The initial bonding time of the adhesive becomes particularly important if the production rate of the wrapping apparatus is increased and/or if stiff overlay materials such as "Balacron" or "Skivertex" are used.

Continuing to discuss the problem of insuring reliable adhesive bonding, the consequence of a pressing time for the wrap-folded overlay material which is too short is that the overlay material will subsequently separate from the cover board. Any such separation is the cause of significant production problems, particularly during the operations which must subsequently be performed on the cover unit such as pulling-in the corners and wrapping the side edges.

To summarize the above discussion, prior art wrapping techniques and apparatus as exemplified by the disclosure of U.S. Pat. No. 2,749,967 are incapable of achieving the sharp-edged finish that is desired in book cover production and such prior apparatus and techniques often result in air entrapment between the overlay material and the cover board, hollow edges and wrap separation.

Another example of a prior art method and apparatus for use in the manufacture of book covers, particularly for wrapping overlay material around cover boards, may be seen from U.S. Pat. No. 2,667,909. In the apparatus of U.S. Pat. No. 2,667,909 the cover units, comprising the overlay material pre-bonded to the cover boards, are caused to move through a pair of cylindrical segments. During the course of this movement, the overlay material that projects beyond the cover board leading edge is first folded downwardly through the action of a folder plate installed in the upper cylindrical segment. The downwardly folded overlay material is caused to emerge through an aperture under the influence of control devices and is subsequently held in the folded position by the action of an air blast. The folded flap is subsequently pressed against the cover board as the moving cover unit passes between pressure rollers. In order to wrap the trailing edge of the cover unit, a second folder plate is installed in the upper cylindrical segment and, under the influence of a control device, produces the downward folding of the overlay material which projects beyond the trailing edge of the cover board. The lower cylindrical segment has a driving plate which is movable in the direction of travel of the cover unit. This driving plate further folds the overlay material and presses it firmly against the cover board from below until the cover unit is received between the pressure rollers.

Apparatus of the type disclosed in U.S. Pat. No. 2,667,909 cannot achieve the "initial bonding time" since neither the folder plates, which are moved relatively rapidly past the board edges, for the pressure rollers, which act only briefly on the cover unit, are designed to maintain their pressure for an extended period of time.

It is also to be noted that, in apparatus of the type exemplified by U.S. Pat. No. 2,667,909, only small push forces are exerted by the folder plates as they move past the cover board edges and these forces are insufficient to pull the overlay materials tautly around the board edges, this being particularly true if the overlay materials are relatively stiff. Similarly, this type of prior art apparatus is also incapable of achieving the sharp-edged finish, free of air pockets and hollow edges, which is desired. This is particularly true in the case of the leading-edge wrapping operation in which merely an air blast is used for holding the folded wrapping material.

SUMMARY OF THE INVENTION

The present invention overcomes the above briefly discussed and other deficiencies and disadvantages of the prior art by providing a novel and improved technique for the production of high quality book covers at high production rates. The invention also encompasses apparatus for implementing this novel technique wherein means are provided for folding upwardly the overlay material which projects beyond the leading and trailing edges of the cover board and subsequently further folding of this turned-up material over and pressing it into firm contact with the continuously moving cover board. This apparatus comprises cooperating wrapping systems for wrapping the leading and trailing edges of a cover unit, these wrapping systems being separated by a defined but adjustable distance and being propelled by drive means so as to be movable on an endless path. Each wrapping system comprises a wrapping rail which extends transversely to the direction of cover unit movement and which is pivotally mounted on a support member. The wrapping rails are controlled in a displacement-dependent mode and cooperate with an associated support rail to form a clamp. The wrapping rail which operates on the leading edge of the cover unit is actuated first, through the agency of control devices, to turn the overlay material extending from an incoming cover unit upwardly along the leading side surface of the cover board. The leading-edge wrapping rail moves upwardly and, once the cover unit is supported by the associated support rail, the leading edge wrapping rail is moved counter to the direction of movement of the cover unit so as to fold the overlay material over and to then press the folded overlay material firmly against the cover board. The cover unit is then held clamped between the leading edge wrapping rail and its associated support rail. The trailing-edge wrapping rail, actuated similarly through the agency of control devices, then folds the overlay material extending from the trailing edge of the cover board. The trailing edge wrapping rail moves upwardly and, when the cover unit is supported by the support rail associated with the trailing-edge wrapping rail, the trailing-edge wrapping rail moves in the direction of movement of the cover unit so as to fold the overlay material over and downwardly against the surface of the cover board, such folding being executed at a speed which is excess of the speed of movement of the cover unit. The railing-edge wrapping rail and its associated support rail clamp the folded-over overlay against the cover board until the cover unit is released by appropriately located control devices.

Apparatus in accordance with the present invention achieves optimum stretching of the overlay material around the cover board edges and towards the center line of the cover unit, this stretching being achieved through the use of wrapping rails which move in continuous pressure contact, firstly with the edge surfaces of the boards and immediately thereafter with the face surfaces of the boards. Also, once the overlay material has been pulled taut, the cover unit is held during its continuing movement over a defined distance, i.e., the cover unit is clamped in a clamping gap formed by wrapping rails and support rails until being released for delivery to downstream transport means.

In the operation of the present invention, during the wrapping procedure, hold-down elements press the cover unit against the support rails and, accordingly, the cover unit does not itself have to absorb the forces generated by the wrapping rails. Gentle treatment of the cover unit is guaranteed by elimination of relative movement between the cover unit and the surfaces on which it is supported. This permits the employment of relatively large folding forces and, in turn, makes it possible to use a wide variety of materials for the overlay. The present invention also makes it possible to produce high quality book covers at high repetition rates, even with stiff overlay materials. Moreover, by reason of the amount of time available for clamping, there is no need to impose special requirements on the adhesive and, particularly, a low-viscosity adhesive can be utilized in the interest of minimizing the well-known problem of adhesive stains.

BRIEF DESCRIPTION OF THE DRAWING

The present invention may be better understood and its numerous objects and advantages will become apparent to those skilled in the art by reference to the accompanying drawing wherein like reference numerals refer to like elements in the several figures and in which.

DESCRIPTION OF THE DISCLOSED EMBODIMENTS

Figure 1:
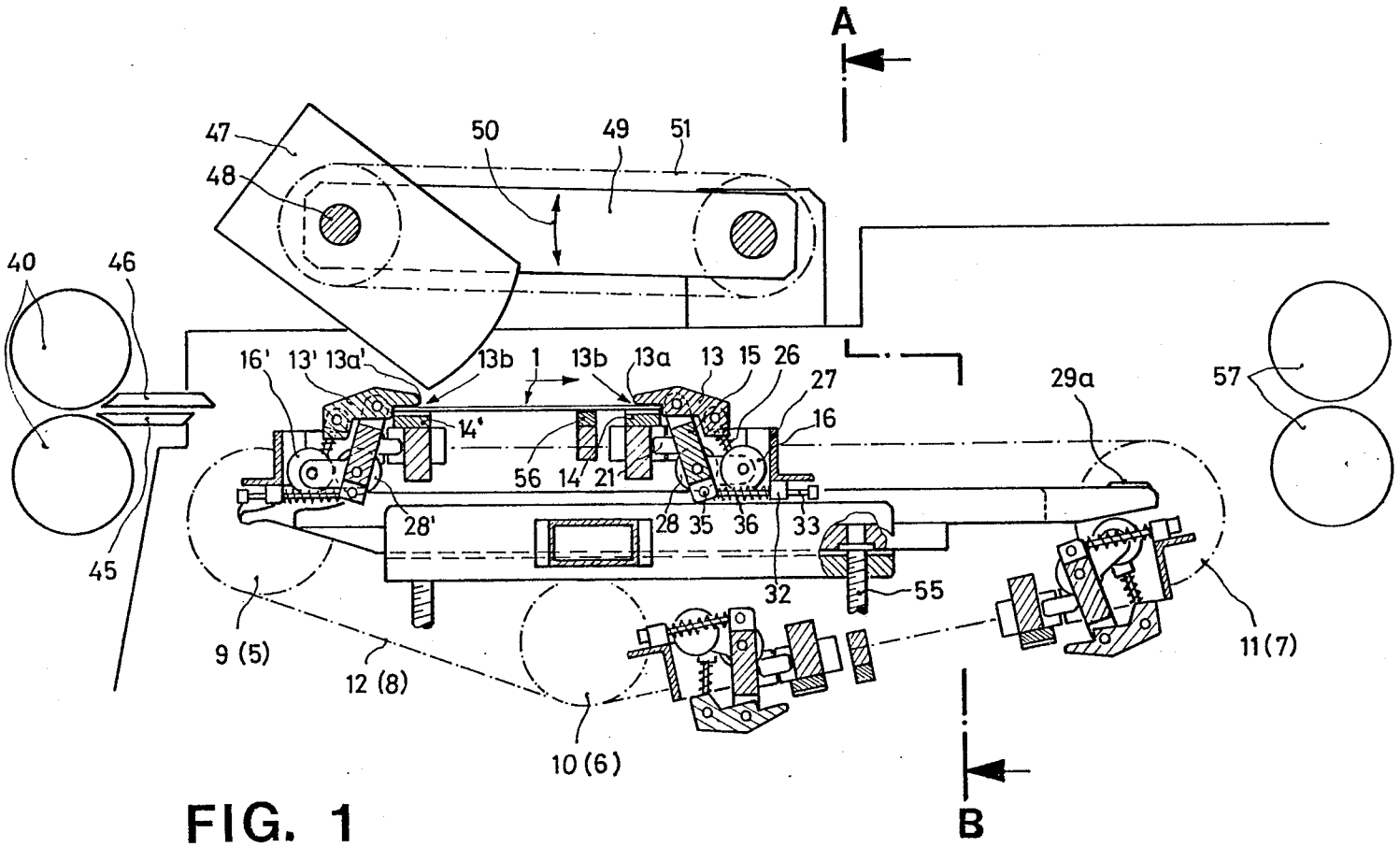
FIG. 1 is a schematic side elevation view, partly in section, depicting apparatus in accordance with a preferred embodiment of the present invention.
Figure 2:
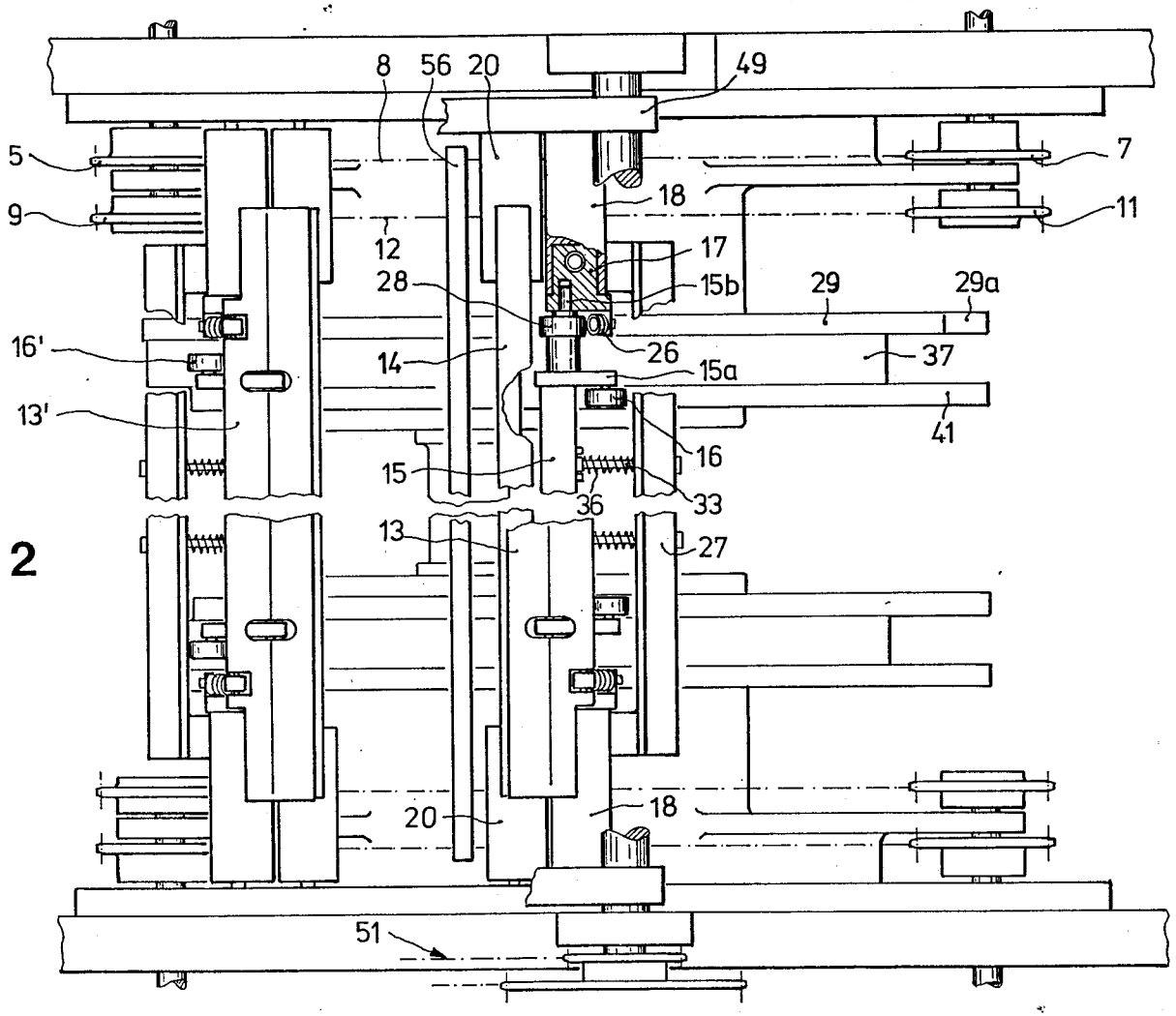
FIG. 2 is a plan view of the apparatus of FIG. 1.

With reference now to the drawing, the basic construction of the disclosed embodiment is believed to be best seen from FIG. 1. The function of the disclosed apparatus is to wrap overlay materials, which have been adhesively bonded to backing boards, around the leading and trailing edges of the backing boards in the course of producing book covers. In the disclosed embodiment, the apparatus comprises driven chains that move on endless paths and carry wrapping systems. These wrapping systems, i.e., the pairs of cooperating leading and trailing systems in reference to the direction of book cover movement, serve both to turn up the overlay material and to fold it around the leading and trailing edges of the continuously moving boards. In a typical application, and in order to achieve a high production rate, a total of four wrapping systems are preferably installed on the driven chains. In order to facilitate understanding of the invention, however, the description below will primarily refer to a single side of the wrapping apparatus, i.e., a single pair of wrapping systems, although it is to be understood that the components to be described will be present on both sides if the apparatus is viewed in the longitudinal direction.

The leading-edge and trailing-edge wrapping systems are installed on separate chain assemblies which lie in parallel planes and which are continuously driven from a common drive unit, not shown. In the disclosed embodiment, the leading-edge wrapping systems are installed on outwardly-disposed chains 8 which are engaged by direction-changing sprockets 5, 6 and 7. The trailing-edge wrapping systems of the disclosed embodiment are installed on chains 12, located inwardly with respect to chains 8, which are engaged by direction-changing sprockets 9, 10 and 11. The installation of the wrapping systems on separate chain assemblies enables the apparatus to be adjusted to accommodate book covers of different size. Such adjustment is accomplished by shifting the chains 8, and thus the leading-edge wrapping systems, relative to the chains 12, and thus the trailing-edge wrapping systems, either in or counter to the chain running direction as appropriate.

Each of the wrapping systems comprises a leading-edge wrapping rail 13, with a cooperating support rail 14, and a trailing-edge wrapping rail 13', which has a cooperating support rail 14'. The wrapping and support rails extend transversely to the direction of movement of the cover units 1, i.e., a backing board with an overlay sheet adhered thereto. The wrapping rails 13 indirectly interconnect the chains 8 and the wrapping rails 13' indirectly interconnect the chains 12.

Since the construction of the leading-edge wrapping systems is essentially the same as that of the trailing-edge systems, the following discussion will be primarily directed to a leading-edge system.

Figure 3:
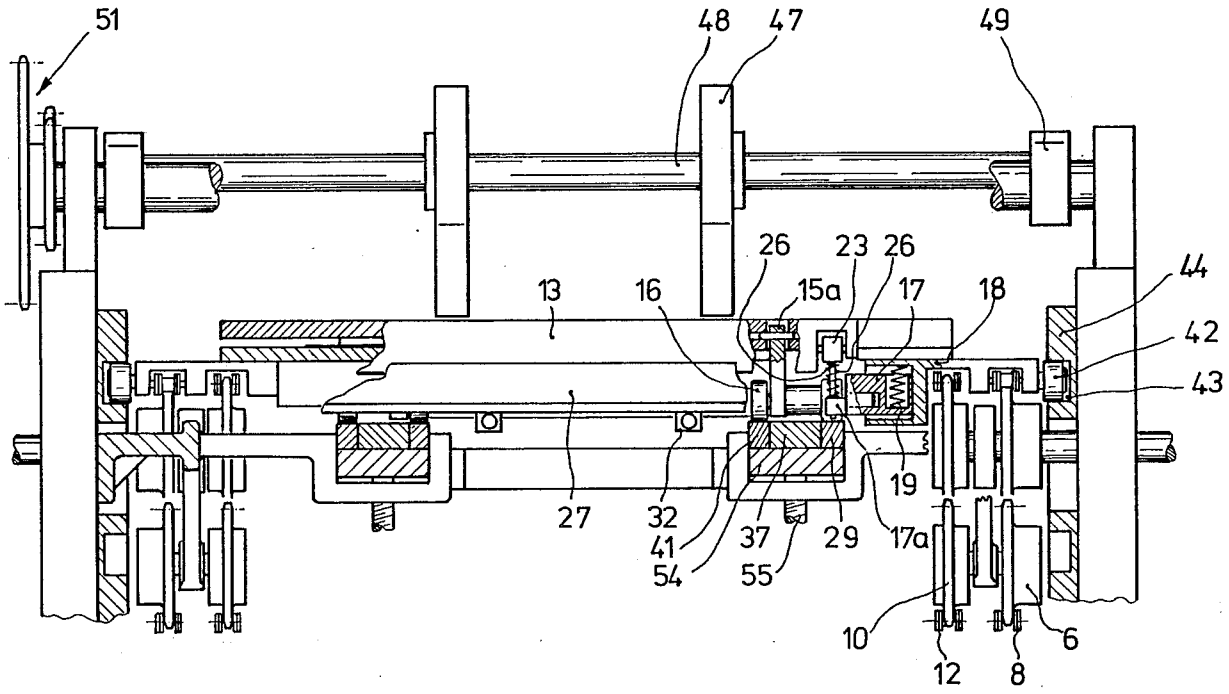
FIG. 3 is a cross-section view taken along line A–B of FIG. 1.

The wrapping rail 13 has a rounded working surface 13a and is tiltably mounted in a cross member 15. The cross member 15 is provided with arms 15a which extend outwardly therefrom. A follower roller 16 is mounted on extension arm 15a and is freely rotatable. The cross member 15 is integral with an axle 15b having a stepped portion that is received in a support bearing 17. The support bearing 17, in turn, is mounted in a driving element 18 in a manner such that it can slide freely in the vertical direction. As may be seen from FIG. 3, a compression spring 19 biases the support bearing 17 in a first direction.

The cross member 15, with its wrapping rail 13, is articulated to a drive chain 8 via driving elements 18. Further driving elements 20 are located immediately adjacent to the driving elements 18. The driving elements 20 function as carriers for the support rail 14 which cooperates with the wrapping rail 13. The driving elements 20 are coupled to the driving elements 18 by means of articulated links 21 as shown in FIG. 1.

The wrapping rail 13 and its cooperating support rail 14 define a clamping means which receives a rectangular region of the cover unit 1 abutting the leading edge of the cover unit backing board. The clamping zone or region is in part defined by a cover unit receiving rectangular recess 13b provided in the wrapping rail 13.

A defined contact pressure for application to the clamped cover unit 1 is provided by a compression spring 26. Compression spring 26 extends between an extension 17a, formed integrally with the support bearing 17, and a counter-bearing 23 mounted in the wrapping rail 13.

A control roller 28 is installed on the axle 15b of cross member 15. Roller 28 travels along a control track 29 in the course of its orbiting movement. The cross member 15 can pivot about axle 15b, and the control roller 28 is kept in contact with the track 29 by means of the above-mentioned compression spring 19.

As noted above, a driving element 18 is installed at each end of the wrapping rail 13. The driving elements 18 are interconnected by a connecting rail 27. Connecting rail 27 carries a bearing block 32 through which a tie rod 33 passes. The tie rod 33 is articulated to a horn 35, which extends from the cross member 15, and is provided with a head which functions as a stop.

The follower roller 16 of the leading wrapping system is kept in contact with a control track 41 by means of a compression spring 36 which is seated on tie rod 33. The compression spring 36 extends between the connecting rail 27 and the horn 35 which, as noted, extends from the cross member 15. In the case of the trailing edge wrapping system, a follower roller 16' is kept in contact with a control track 37 by an analogous arrangement of parts.

I order to eliminate the necessity of having the drive chains fulfill guidance functions, and to also ensure that the chains are subjected only to tension forces, the driving elements 18 are provided, at their opposite ends, with rollers 42. The rollers 42 travel in guide slots 43 in a machine frame 44 as the chains move on their endless paths.

The cover units 1 are delivered to the apparatus of the present invention via a support table 45 by means of transport rollers 40. The cover units ejected from the rollers 40 enter the region in which the leading edge wrapping system operates and are held on the table 45 by an upper holding rail 46. Upper hold-down segments 47 are provided for applying holding pressure during the portion of the operating cycle in which the overlay material is turned up around the trailing edge of the cover board. The segments 47 are driven in a manner such that they rotate, touching down on the continuously moving cover units, in synchronism with the cover unit movement. The hold-down segments 47 are installed on a shaft 48, which is positioned by means of cantilever arms 49 mounted in the machine frame 44, such that they may be swung in the directions indicated by arrow 50 on FIG. 1. Thus, the hold-down segments can be vertically adjusted to accommodate different cover material thicknesses. The hold-down segments 47 are rotated by means of a chain drive 51.

The control tracks 29, 37 and 41 are mounted on a support body 54 and are vertically adjustable by means of lifting spindles 55. The lifting spindles 55 are supported in the machine frame and enable the distance between the wrapping rails 13 and 13, and their cooperating support rails 14 and 14' to be varied so as to accommodate different cover material thicknesses.

Figure 7:
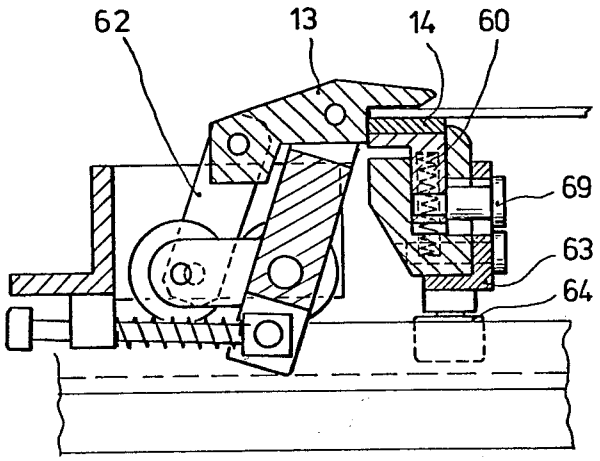
FIGS. 6 and 7 partially depict a modified embodiment of apparatus in accordance with the invention.
Figure 6:
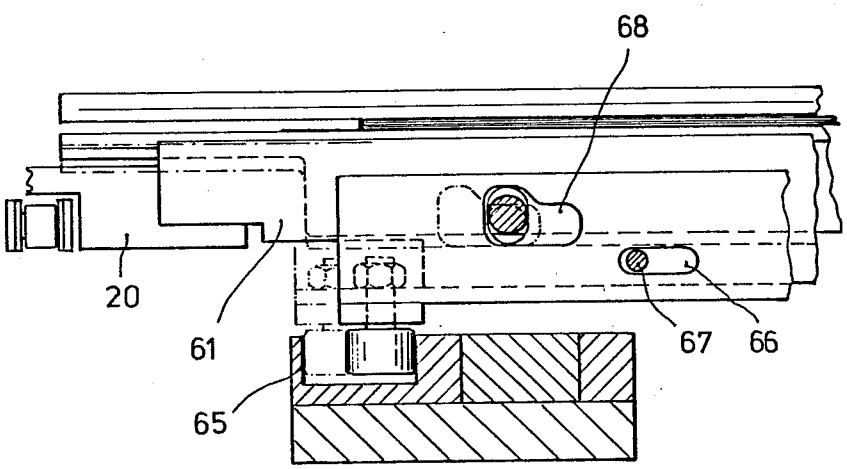

As previously mentioned, a defined contact pressure is applied to a clamped cover unit 1 via the action of a compression spring 26 extending between the extension 17*a* of the support bearing 17 and the counter-bearing 23 on the wrapping rail 13. Referring to FIGS. 6 and 7, in order to enable a larger force to be applied and in order to facilitate the processing of comparatively stiff overlay materials, the apparatus may be modified such that the support rails 14 press against the wrapping rails 13 under the action of spring elements 60. In this modified arrangement, compression springs of different strength can be used so as to enable the compressive force to be varied. Continuing to refer to FIGS. 6 and 7, the support rails 14 are, in the alternative embodiment, spring-mounted on a structural component 61 via driving elements 20, the driving elements acting as carriers. In the alternative embodiment, a linking lever 62 replaces the compression springs 26.

In order to open the clamp defined by the wrapping rail 13 and the support rail 14, the rail 14 is functionally connected to a control beam 63. A control roller 64 is installed on beam 63 and engages a cam slot 65 in order to cause a transverse displacement of the beam 63. The beam 63 is retained on the structural components 61 via pins 67 which engage elongated holes 66. Thus, the lowering movement of the support rail 14 is brought about by the transverse displacement of the control beam 63 resulting from the beam 63 being provided with control slots 68 through which pins 69 extend, the pins seating in the structural component 61.

Also in the interest of compensating for material thickness variations, the support rail 14 is designed to be formed by two shorter portions.

The mode of operation of the wrapping apparatus will now be described. FIGS. 4*a–d* and 5*a–d* illustrate how the overlay material is wrapped around the cover board edges in the individual movement phases. FIGS. 4*a–d* relate to the wrapping of the leading edge of the cover board while FIGS. 5*a–d* depict the wrapping of the overlay about the trailing edge of the cover board.

Figure 4A:
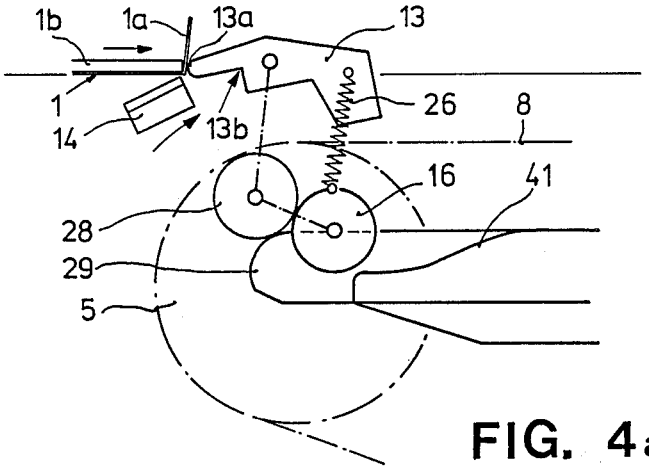
FIGS. 4*a*–4*d* schematically illustrate the sequence of movement phases involved in wrapping the leading edge of a cover unit during operation of the apparatus of FIGS. 1–3.
Figure 4B:
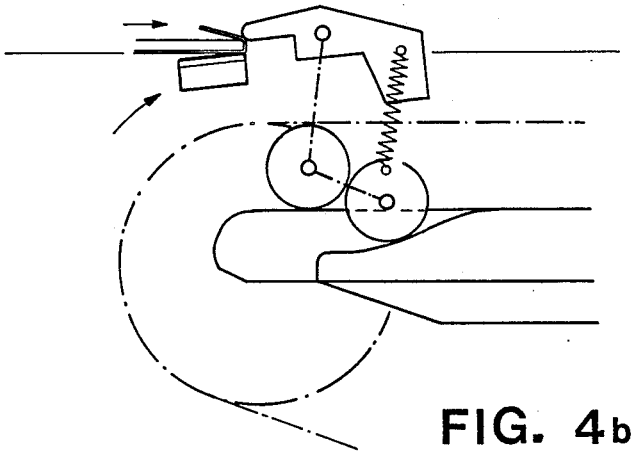
Figure 4C:
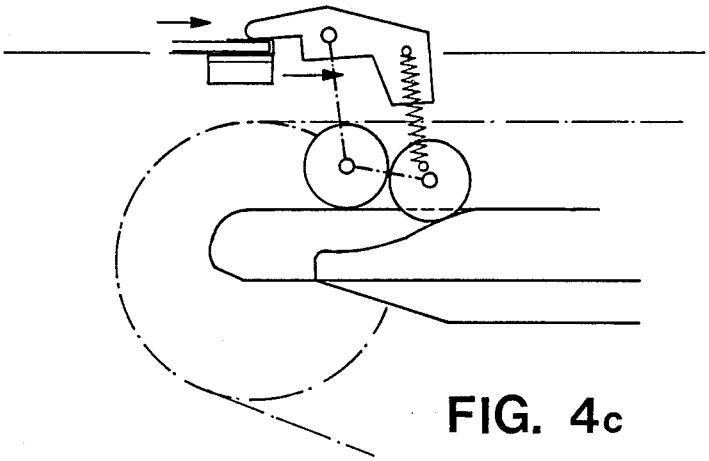
Figure 4D:
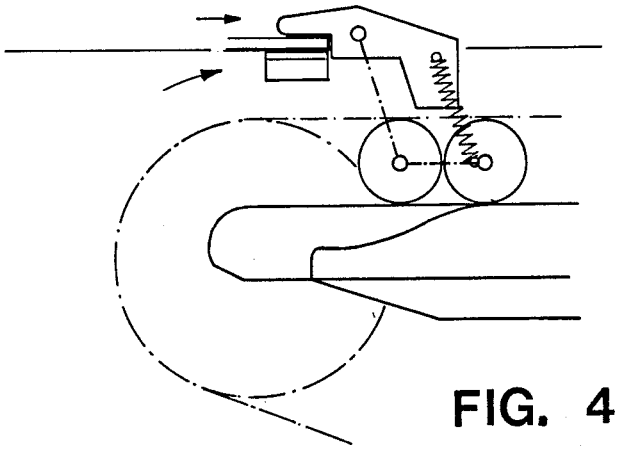
Figure 5A:
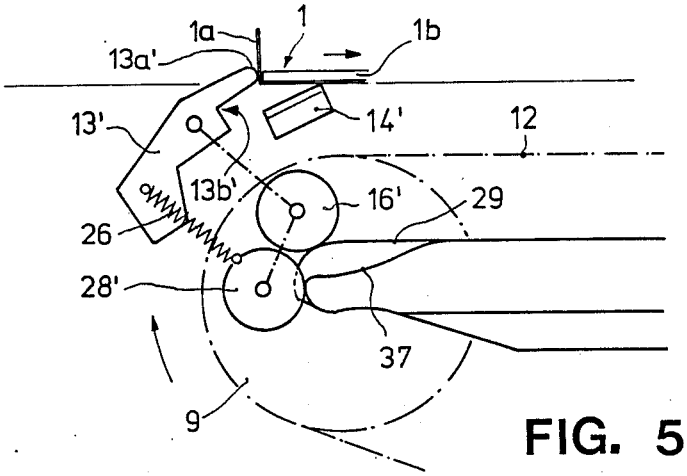
FIGS. 5a–5d schematically illustrate the sequence of movement phases involved is wrapping the trailing edge of a cover unit during operation of the apparatus of FIGS. 1–3.
Figure 5B:
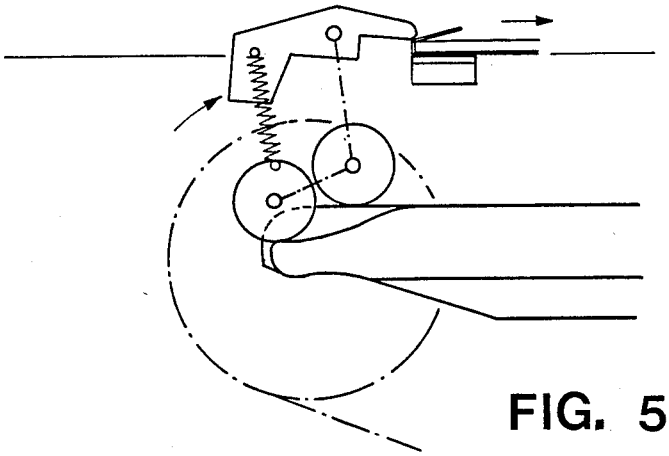
Figure 5C:
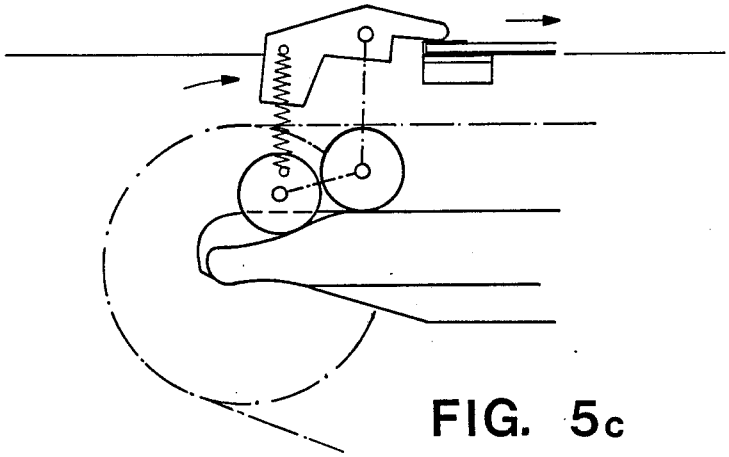
Figure 5D:
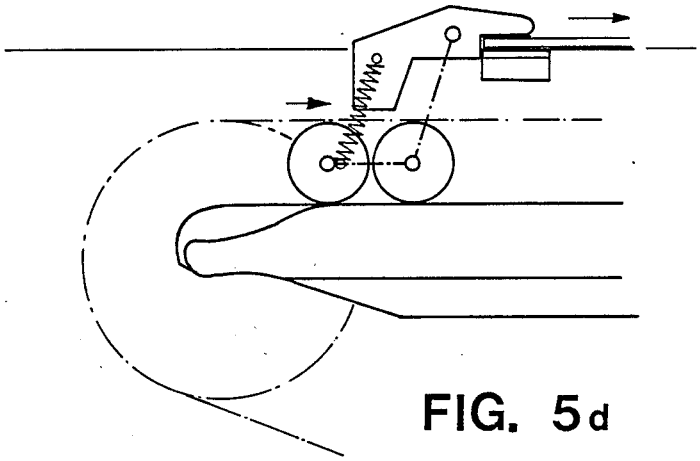

A cover unit 1 is guided between the support table 45 and the holding rail 46, and enters the region in which the wrapping systems operate. As noted, the wrapping systems are propelled in a manner such that they continuously move on an endless path. In the course of this orbiting movement, the wrapping rail 13 of the leading-edge wrapping system first turns up the overlapping material 1*a* which projects beyond the leading edge of the cover board, the overlay being turned up along the leading side surface of the board. The foregoing procedure is produced as a result of the follower roller 16 and control roller 28 running onto respective control tracks 29 and 41 and is represented in FIG. 4*a*. Once the leading-edge clamping zone of the cover unit is supported by the support rail 14, which has been moved to meet the cover unit, the wrapping rail 13 folds the overlaying material 1*a* back around the upper edge of the cover board as a result of a movement of the rail counter to the direction in which the cover unit is moving. The wrapping rail 13 rubs the overlaying material into contact with the cover board, acting in the direction towards the middle of the cover unit, and holds the cover unit clamp between itself and the support rail 14.

The clamped cover unit 1 is now transported forwardly by the leading edge wrapping system and enters the region in which the trailing-edge wrapping system operates. The trailing-edge wrapping system is propelled in a manner such that it moves together with the leading-edge wrapping system, on the same endless path, and in the course of this orbiting movement the trailing edge wrapping rail 13, turns up the overlay material 1*a* which projects beyond the trailing edge of the cover board. The overlay material is folded upwardly along the trailing side surface of the cover board as a result of the control rollers 28' and follower rollers 16' running onto the control tracks 29 and 37. This operation is depicted in FIGS. 5*a–d*. Once the support rail 14' has been moved into position beneath the trailing edge clamping zone of the cover unit and the hold-down segment 47 has engaged the cover unit, the trailing edge wrapping rail 13 folds the overlay material back around the upper edge of the cover board. This folding is a consequence of an overtaking movement of wrapping rail 13', i e. a movement executed at a speed in excess of that at which the cover unit is moved, and results in the overlay being rubbed into contact with the cover board in the direction of the middle of the cover unit. The cover unit is now also clamped between trailing edge wrapping rail 13, and its support rail 14'.

The rubbing of the overlay material la into contact with the cover board 1*b* is effected in an advantageous manner, i.e., the wrapping rails 13 and 13' are oriented such that they are tilted toward the middle of the cover unit 1. This results in a force component being exerted on the overlay material 1*a* at an angle to the board via the rounded working surfaces 13*a* and 13*a'* of the wrapping rails. This inclined force component reinforces the rubbing-on effect discussed above which is directed toward the middle of the cover unit.

The moving and partially finished cover unit 1, clamped by the leading-edge and trailing-edge wrapping systems, is released in the delivery area of the wrapping apparatus. The leading-edge wrapping system first releases the cover unit as a result of the control roller 28 running onto a cam 29*a* on the control track 29, this action causing the lifting of the wrapping rail 13. The wrapping rail 13 and support rail 14 are then moved downwardly over the chain direction-reversal arrangement. The cover unit, which is continued to be transported forwardly by the trailing-edge wrapping system, while being supported on a bolster rail 56 which is carried by the chain assembly 5, 8, arrives in the vicinity of a pair of transport rollers 57. The transport rollers 57, when the trailing-edge wrapping system defined clamp is released, engages the cover unit and directs it to a downstream located processing station. The release of the trailing-edge wrapping system results from its control roller running onto the cam 29*a* on the control track 29.

While preferred embodiments have been shown and described, various modifications and substitutions may be made thereto without departing from the spirit and scope of the invention. Accordingly, it is to be understood that the present invention has been described by way of illustration and not limitation.

We claim:

1. In a wrapping machine for use in the production of book covers, the covers being formed from cover units having a two-sided flat cover board with an overlay material in contact with a first side thereof, the overlay material extending beyond edges of the cover board, the cover units being transported overlay side down in a plane in a first direction on a conveyer system during the production of the book covers, improved apparatus for forming the overly material about the edges of the cover board which are lending and trailing in the direction of cover unit movement comprising:

at least first cooperating movable wrapping means for the leading and trailing edges of the cover units, said wrapping means being spacially displaced and each comprising:

a wrapping rail which extends transversely with respect to the direction of cover unit movement;

first mounting means for pivotally supporting said wrapping rail, said first mounting means being movable relative to the conveyor system transport plane;

a support rail which extends transversely with respect to the direction of cover unit movement; and second mounting means for supporting said support rail said second mounting means being movable relative to the conveyor system transport plane to position said support rail for cooperation with said wrapping rail to defined a moving cover unit edge clamp;

drive means for said wrapping means, said drive means being coupled to said wrapping means and defining an endless path for said mounting means, said drive means being adjustable whereby the separation between said leading and trailing wrapping means may be varies;

first control means for imparting movements to said leading wrapping means as it travels under the influence of said drive means, said first control means imparting movement to said first mounting means to cause said first mounting means to move toward said conveyor system transport plane to thereby cause said leading edge wrapping rail to engage and deflect upwardly overlay material extending beyond the leading edge of the moving cover board, said first control means subsequently causing said first mounting means to move said leading edge wrapping rail in a direction which is counter to the direction of motion of the cover unit to thereby fold the overlay material around the leading edge of the cover board and clamp the folded overlay material and cover board between the wrapping and support rails of said wrapping means;

second control means for imparting movements to said trailing edge wrapping means as it travels under the influence said drive means, said second control means causing said second mounting means to move toward said conveyor system transport plane to thereby cause said trailing edge wrapping means to engage and deflect upwardly overly material extending beyond the trailing edge of the cover board, said second control means thereafter causing said second mounting mans to move said trailing edge wrapping rail in the direction of cover unit movement at a speed in excess of the speed of movement of the cover unit to thereby fold the overly material about the trailing edge of the cover board and clamp the folded overlay material between the wrapping and support rails of the trailing edge wrapping means;

means for sequentially energizing said first and second control means whereby said second control means is not energized until after the cover unit is clamped by said leading edge wrapping means;

hold-down means or retaining the overlay material in the folded over position during continued movement of the cover unit; and means for sequentially returning said movable wrapping rails of said leading and trailing edge wrapping means to their initial positions whereby the cover units are released from the apparatus.

2. The apparatus of claim 1 wherein each wrapping rail is supported on its associated mounting means via a compression spring and applies a contact pressure to the cover unit.

3. The apparatus of claim 2 wherein each wrapping rail has a rounded overlay engaging working surface and is actuated by an associated control means so as to press the folded overlay material firmly against the second side of the cover board, the control means pivoting the wrapping rail into a position in which it is tilted towards the middle of the cover board.

4. The apparatus of claim 1 wherein each wrapping rail has a rounded overlay engaging working surface and is acutated by an associated control means so as to press the folded overlay material firmly against the second side of the cover board, the control means pivoting the wrapping rail into a position in which it is tilted towards the middle of the cover board.

5. The apparatus of claim 4 further comprising at least a second pair of leading-edge and trailing-edge wrapping means coupled to said drive means.

6. The apparatus of claim 5 wherein said wrapping means each further comprise guide means for said wrapping rails and associated mounting means, said guide means including rollers which run in slot tracks.

7. The apparatus of claim 6 wherein said drive means comprises first and second drive chain assemblies, the leading-edge wrapping means being coupled to a first of said chain assemblies and the cooperating trailing-edge wrapping means being coupled to the second of said chain assemblies, said first and second chain assembles being relatively adjustable whereby said apparatus may accommodate different sizes of cover.

8. The apparatus of claim 1 further comprising at least a second pair of leading-edge and trailing-edge wrapping means coupled to said drive means.

9. The apparatus of claim 8 further comprising a bolster rail which is installed between the pairs of wrapping means, said bolster rail being positioned in front of the leading-edge wrapping rail, said bolster rail being carried by said drive means and supporting the cover unit once it has been released by the leading edge wrapping means and is being clamped and transported forwards by the trailing-edge wrapping means.

10. The apparatus of claim 1 wherein said wrapping means each further comprise guide means for said wrapping rails and associated mounting means, said guide means including rollers which run in slot tracks.

11. The apparatus of claim 1 wherein each wrapping rail is provided with a rectangular recess which cooperates with a support rail to form a clamping gap for clamping the cover board and folded overlay.

12. The apparatus of claim 1 wherein said hold-down means comprises hold-down elements which act on the zone of the cover board and folded overlay near the trailing edge, in synchronism with the movement of the cover board and overlay, said hold-down elements comprising segments which are driven in a manner such that they rotate.

13. The apparatus of claim 1 wherein said drive means comprises first and second drive chain assembles, the leading-edge wrapping means being coupled to a first of said chain assemblies and the cooperating trailing-edge wrapping means being coupled to the second of said chain assemblies, said first and second chain assemblies being relatively adjustable whereby said apparatus may accommodate different sizes of cover.

14. The apparatus of claim 1 wherein said control means include control tracks which are vertically adjustable to accommodate covers made of materials of different thicknesses.

15. The apparatus of claim 1 wherein said mounting means each comprise a cross-member and a side-located driving element articulated to said drive means, the cross-member being resiliently mounted in the driving elements by support bearings.

16. The apparatus of claim 1 wherein said second mounting means each comprise a spring element for resiliently biasing a support rail towards its associated wrapping rail so as to apply a contact pressure to the cover unit.

17. The apparatus of claim 16 wherein said second mounting means engage a support rail such that it can be shifted vertically and can be lowered counter to the action of said spring element, said means for returning causing the lowering of the support rail.

18. The apparatus of claim 17 further comprising means for varying the contact pressure generated by each spring element.

19. The apparatus of claim 16 further comprising means for varying the contact pressure generated by each spring element.

20. The apparatus of claim 1 wherein said support rails are defined by a plurality of segments.

* * * * *